US005159391A

United States Patent [19]

Koshi et al.

[11] Patent Number: 5,159,391

[45] Date of Patent: Oct. 27, 1992

[54] ELECTROPHOTOGRAPHIC IMAGE RECORDING APPARATUS WITH FEED ROLLERS FOR ORIENTATING A SHEET UPWARDLY AT A TRANSFER STATION

[75] Inventors: Makoto Koshi; Yoshihiro Tonomoto, both of Kawasaki; Shizuo Takano, Fukushima; Masayuki Hida, Kawasaki; Masao Konishi, Hachioji, all of Japan; Katsumi Tateno, San Jose, Calif.

[73] Assignee: Fujitsu Limited, Kawasaki, Japan

[21] Appl. No.: 555,370

[22] Filed: Jul. 20, 1990

Related U.S. Application Data

[63] Continuation of Ser. No. 191,159, May 6, 1988, abandoned.

[30] Foreign Application Priority Data

May 6, 1987 [JP] Japan ..... 62-108998
May 15, 1987 [JP] Japan ..... 62-116992
Sep. 14, 1987 [JP] Japan ..... 62-228364

[51] Int. Cl.[5] ..... G03G 15/14

[52] U.S. Cl. ..... 355/271; 355/282; 355/311; 355/315

[58] Field of Search ..... 355/271, 274, 276, 282, 355/289, 290, 315, 285, 308, 309, 311; 219/216; 271/193, 900

[56] References Cited

U.S. PATENT DOCUMENTS 3,940,126 2/1976 Cooper ..... 271/900 X
4,009,957 3/1977 Suzuki et al. ..... 355/309 X
4,017,067 4/1977 Soures et al. ..... 355/312 X
4,110,024 8/1978 Gundlach ..... 355/276
4,408,863 10/1983 Ogata et al. ..... 355/271
4,429,984 2/1984 Kiba et al. ..... 355/309
4,444,486 4/1984 Monkelbaan ..... 355/295
4,544,262 10/1985 Kanemitsu et al. ..... 355/315
4,939,550 7/1990 Takada et al. ..... 355/290 X

FOREIGN PATENT DOCUMENTS 0017034 2/1979 Japan ..... 219/216
0048859 3/1985 Japan ..... 271/193
0235177 11/1985 Japan .
61-141470 6/1986 Japan .
0175649 8/1986 Japan .
0194261 8/1987 Japan .

*Primary Examiner*—A. T. Grimley
*Assistant Examiner*—Robert Beatty
*Attorney, Agent, or Firm*—Staas & Halsey

[57] ABSTRACT

An electrophotographic recording apparatus includes a photoconductive drum having a toner image developed on a surface of the drum, a transfer station having a transfer unit located above the photoconductive drum to transfer the toner image onto an underside surface of a paper moving along a predetermined path extending between the photoconductive drum and the transfer unit. The paper will be fed toward the transfer station in an upward orientation by feed rollers. Also, a fixing unit is provided along the path and downstream of a point of separation of the paper from the photoconductive drum, to fix the toner image onto the paper with the recorded surface facing down when the paper is ejected from the transfer station, and a guide for smoothly guiding the leading end of the paper into an entrance of the fixing unit.

17 Claims, 12 Drawing Sheets

Fig. 1
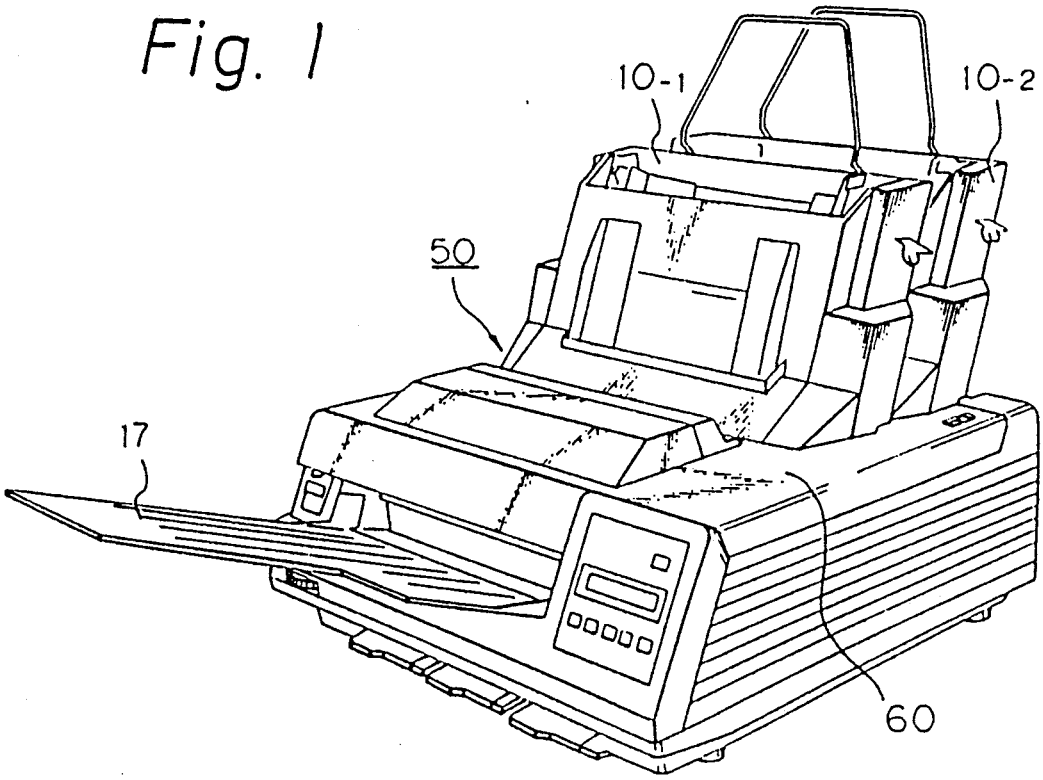
Fig. 2B
Fig. 2A
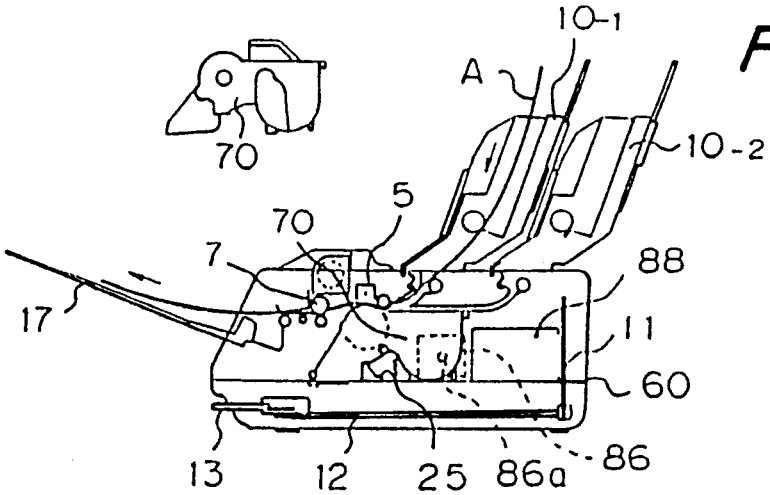

ELECTROPHOTOGRAPHIC IMAGE RECORDING APPARATUS WITH FEED ROLLERS FOR ORIENTATING A SHEET UPWARDLY AT A TRANSFER STATION

This is a continuation of copending application Ser. No. 07/191,159 filed on May 6, 1988, now abandoned.

BACKGROUND OF THE INVENTION

1. Field of the Invention

The present invention relates to an electrophotographic apparatus, such as an electrophotographic printer or copier, for making and recording an image, and more particularly, it relates to a compact electrophotographic recording apparatus in which a face-down, correct-order stack of recorded cut sheets can be produced.

2. Description of the Related Art

In an electrophotographic printer, a light emitting diode (LED) array changes image data, stored in a memory in a page format, into light patterns. These light patterns are used to form a latent image on a photoconductive drum by an array of LED's. A photoconductive drum is then rotated and a developing unit distributes charged small particles, called toner, which consist of carbon and resin, onto the photoconductive drum while the drum is rotated. The toner adheres to areas on the drum which do not have a charge, i.e., develops a latent image and thus produces a visible image on the drum. Paper fed from a hopper is given a charge having a polarity opposite to that of the toner by a corona discharger and brought into contact with the drum. Thus, the toner is transferred to the paper as a visible image. The toner is then melted by a heat roller to form a permanent image on the paper while the paper is passing through the heat roller, and the resultant printed paper is sent to a stacker.

Various compact electrophotographic printers using a toner, which provide a high quality and stable printing of cut sheets, are generally known. However in these conventional compact electrophotographic printers, the printed papers are stacked in reverse order. Namely, in the stack of printed papers, the printed surfaces of which face upwards the first page is located at the bottom of the stack and the last page is located at the top. This requires a time-wasting rearrangement by a user of the order of the pages of printed-out paper or requires the addition of a paper tipping device, usually provided downstream of a fixing unit, to reverse the printed surface of the paper, making the printer large, expensive and complex.

Compact electrophotographic printers in which a correctly ordered stack can be realized without a paper tipping device are also known. In the known electrophotographic printers of this type, the toner forming an image on the photoconductive drum is transferred to the undersurface of the paper to be printed by a transfer unit. Thus the printed papers are sent to a stacker and are stacked therein in a face-down stack.

In this kind of face-down stack compact type printer, the problems arise of a stable feed of the paper along the paper path without a paper jam and a reliable separation of the paper from the photoconductive drum. A complete separation of the paper from the photoconductive drum becomes more difficult when the diameter of the drum is increased. The problem of a stable feed of the paper mainly arises because the paper must be held from the upper side thereof, as the underside of the paper has unfixed toner formed thereon. This means that the paper cannot be slid on and along a paper guide. One solution to the paper hold problem is to utilize a vacuum unit by which the paper can be lifted from above. However, this vacuum suction mechanism makes the printer more expensive, more complex, and larger and thus inhibits the realization of a compact, simple and inexpensive printer. In addition, in the conventional face-down stack printer, the paper tends to collide with a heat roller of the fixing unit, resulting in a paper jam.

SUMMARY OF THE INVENTION

An object of the present invention is, therefore, to eliminate the above-mentioned drawbacks of the known devices by providing a simple electrophotographic recording apparatus which can stably feed a paper (cut sheet) without a paper jam and without damaging an unfixed toner image formed on the underside of the paper.

Another object of the present invention is to provide a simple, compact electrophotographic recording apparatus which can ensure a complete separation of the paper from an image carrier (photoconductive drum, belt, etc.), regardless of the diameter of the image carrier.

To achieve the above objects, according to the present invention, there is provided an electrophotographic recording apparatus including an image carrier having a toner image preformed thereon, a transfer station having a transfer unit located above the image carrier to transfer the toner image to an underside of a recording medium moving along a predetermined path extending between the image carrier and the transfer unit, and a fixing unit provided along said path and downstream of a point at which the recording medium is separated from the image carrier to fix the toner image to the medium having the recorded surface thereof facing down, ejected from the transfer station, said fixing unit having an entrance through which the recording medium having the toner image transferred thereon by the transfer unit is introduced into the fixing unit, and means for smoothly guiding the leading end of the recording medium into said entrance of said fixing unit.

With this arrangement, the leading end of the recording medium, such as a paper, is guided by the guiding means to the entrance of the fixing unit, during the travel thereof after ejection from the transfer station, without causing a paper jam.

According to another aspect of the present invention, there is provided an electrophotographic recording apparatus including an image carrier having a toner image preformed thereon, and a transfer station having a transfer unit located above the image carrier to transfer the toner image to an underside of a recording medium moving along a predetermined path extending between the image carrier and the transfer unit, and means for orienting upward the leading end of the recording medium fed toward the transfer station.

With this arrangement, when the recording medium enters the transfer station, the leading end thereof has a predetermined upward angle of inclination with respect to the horizontal. Accordingly the separation of the recording medium from the image carrier is easily effected.

The invention will be described below in detail with reference to the accompanying drawings, which show embodiments of the invention by way of non-limitative examples. In the illustrated embodiments, the invention is embodied as an electrophotographic printer, but can be widely applied to any image recording apparatus in which an image formed on an image carrier is transferred to a recording medium.

BRIEF DESCRIPTION OF THE DRAWINGS

FIG. 1 is a perspective view showing an electrophotographic printer according to one aspect of the present invention;

FIG. 2A is an internal schematic view showing a paper path and a printing process of an electrophotographic printer shown in FIG. 1;

FIG. 2B is an enlarged view of a process cartridge of the electrophotographic printer shown in FIG. 2A;

DETAILED DESCRIPTION OF THE PREFERRED EMBODIMENTS

Figure 15:
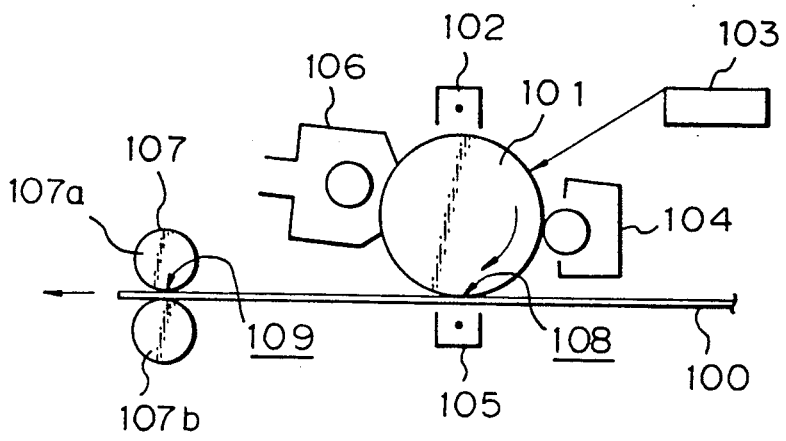
Fig. 15 ( PRIOR ART )
Figure 16:
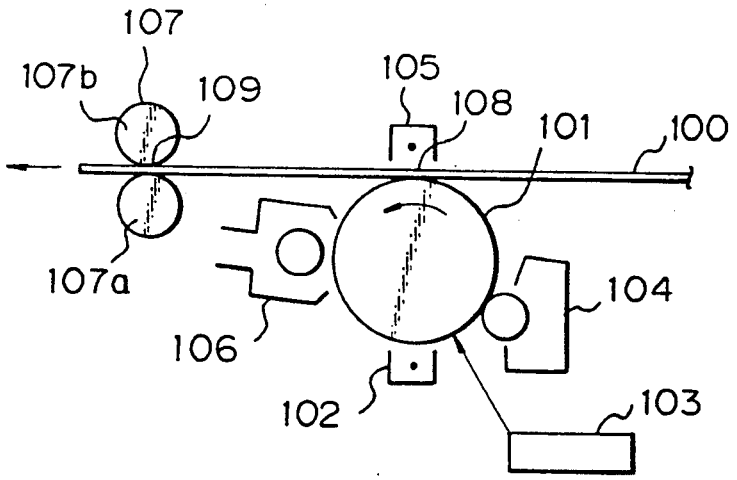
Fig. 16 ( PRIOR ART )

First, reference is made to FIGS. 15 and 16, which show different printing processes of an electrophotographic printer according to the prior art, wherein 101 designates a photoconductive drum (image carrier), 102 a precharger, 103 a latent image forming means (laser or other light source), 104 a developer, 105 a transfer unit, 106 a cleaner, and 107 a fixing unit, which is usually provided with a heat roll 107*a* and a backup roll 107*b*. The elements 102 through 106 are arranged along the circumference of the photoconductive drum 101, which rotates in the clockwise direction. The paper (recording medium) 100 is fed into a transfer station 108 having the transfer unit 105, in synchronization with the rotation of the photoconductive drum 101.

The surface of the photoconductive drum 101 is uniformly charged by the precharger 102, so that a latent image corresponding to an image to be recorded is formed in the photoconductive drum 101. The latent image is developed by the developer 104 to produce a toner image on the photoconductive drum 101. The toner image thus formed is transferred to the upper surface of the paper 100 by the transfer unit 105 in the transfer station 108. The paper 100 is then separated from the photoconductive drum 101, by a curvature separation effect, and fed to a fixing station 109 having the fixing unit 107, by which the toner image is fixed. After the toner image is fixed, the paper 100 is discharged in the direction shown by the arrow and is stacked in a stacker (not shown). After the transfer of the toner image at the transfer station 108, the photoconductive drum 101 is cleaned by the cleaner 106. In general, an AC discharger (not shown) and an eraser or eraser lamp (not shown) are provided on the circumference of the photoconductive drum, after the transfer station 108.

With the printing process shown in FIG. 15, the papers 100 are stacked face up in the stacker. Namely, the subsequent papers 100 are successively laid on the printed surfaces of the preceding papers, which results in a reversed page order. To realize a correct order stack, it is necessary to provide a special paper reversing or tipping mechanism, or the user must manually rearrange the order of pages of the printed papers, as mentioned hereinbefore.

In FIG. 16, which shows another known electrophotographic printer realizing a face-down stack of the printed papers in which the printed papers are stacked in a correct order, i.e., a usual order, the transfer unit 105 is located in the transfer station 108 above the photoconductive drum 101, so that the toner image is transferred to the underface of the paper 100. The printed papers 100 are then successively stacked in a correct order. Namely, the first page is located at the bottom and the final page at the top, of the stack, with the printed surfaces thereof facing down. The present invention is directed to this type, i.e., face-down stack type, of electrophotographic recorder.

In the arrangement shown in FIG. 16, however, in which the fixing station 109 is located on the same horizontal plane as the transfer station 108, the paper 100 tends to collide with the heat roll 107*a* of the fixing unit 107, which is located below the paper path (horizontal plane), since the leading end of the paper 100 tends to droop due to the force of gravity, and thus an undesirable paper jam occurs.

To eliminate this problem of a paper jam in the arrangement shown in FIG. 16, the paper must be held in the horizontal position while traveling between the transfer station and the fixing station. As mentioned previously, the paper must be held on the upper side thereof not on the lower side, since the underside of the paper is the printed surface. The simplest solution thereto may be the provision of a vacuum suction mechanism, but this makes the apparatus more expensive and complicated.

The primary object of the present invention is to realize a smooth and stable conveyance of a paper (recording medium) ejected from the transfer station toward the fixing station, without a paper jam and without providing a special complex device such as the vacuum suction device mentioned above.

In general, when the diameter of the photoconductive drum is relatively small, as in a compact electrophotographic printer (30 mm~40 mm at the most), the paper can be automatically and easily separated (curvature separation) from the photoconductive drum, due to the stiffness of the paper. However, if the stiffness of the paper is low, although the curvature separation takes place, the leading end of the paper may be attracted toward the photoconductive drum due to the presence of static electricity, and thus a paper jam will result.

The present invention also prevents this failure of the paper to separate from the photoconductive drum.

FIGS. 1 and 2A show an appearance and an internal main construction of a compact electrophotographic printer 50 according to one aspect of the present invention. The compact printer has a detachable standard hopper $\mathbf{10}_{-1}$ and an optional hopper $\mathbf{10}_{-2}$, which is not essential to this invention. A stacker 17, which is in the form of a plate, is detachably connected to the front portion of the printer body 60. The papers (cut sheets) 100 (FIG. 15) are stored in the hopper $\mathbf{10}_{-1}$ and/or $\mathbf{10}_{-2}$ and are successively fed into the printer 50 along a paper path A and are stacked on the stacker 17 with the printed surfaces thereof facing down (face-down stack).

The printer 50 is provided with a drive motor 86, which is supplied with electric power by a power supply source 88, for rotating a photoconductive drum (not shown in FIG. 1) and other drive rollers (also not shown in FIGS. 1 and 2). The drive motor 86 is fitted with a drive shaft 86*a* having a gear (not shown) mounted thereon which meshes with a gear (not shown) fitted to the photoconductive drum through a gear train (not shown). The drive motor 86 is controlled by an engine controller (drive controller) 11 which is in the form of a printed circuit board. The illustrated printer 50 can be connected to a computer (not shown), and accordingly, the printer 50 is provided with a controller 12 (emulation board) which is in the form of a printed circuit board, connected to the engine controller 11. The emulation controller 12 serves as an interface to connect the computer, which may have a machine language which cannot be directly applied to the printer, to enable the printer 50 to be driven in accordance with the computer output. 13 designates an IC card or cards.

In FIGS. 2B, a process cartridge 70, which includes the photoconductive drum 1 and surrounding components thereof other than the LED array (latent image forming means) 25 and the transfer unit 5, can be detached as a unit.

Figure 3:
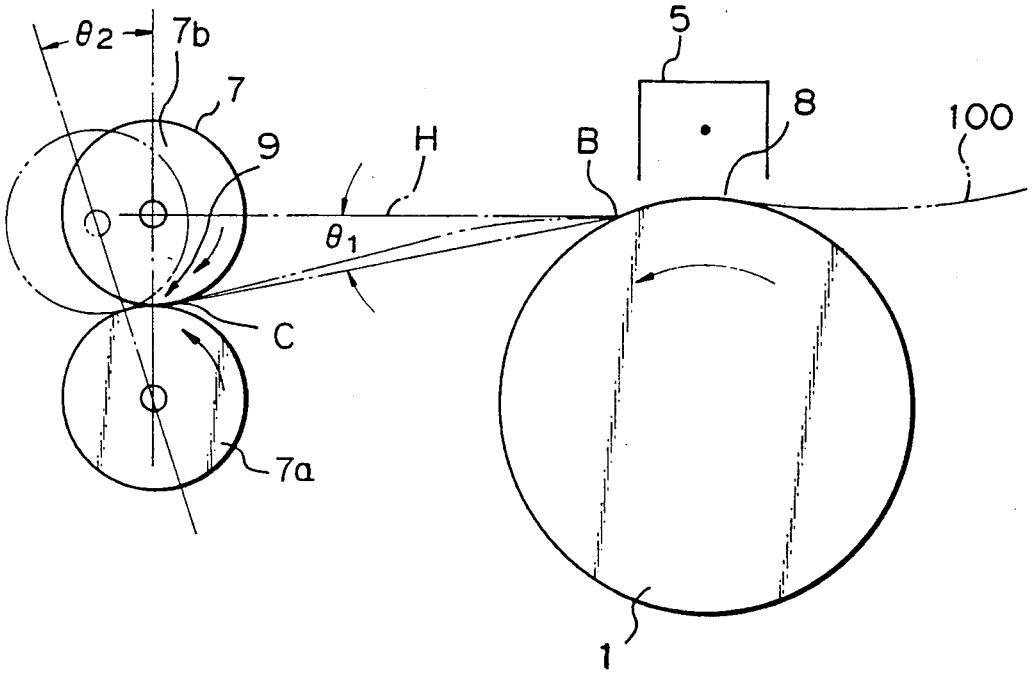
FIG. 3 is a schematic view showing a lower location of a fixing station with respect to a transfer station according to an aspect of the present invention.
Figure 4:
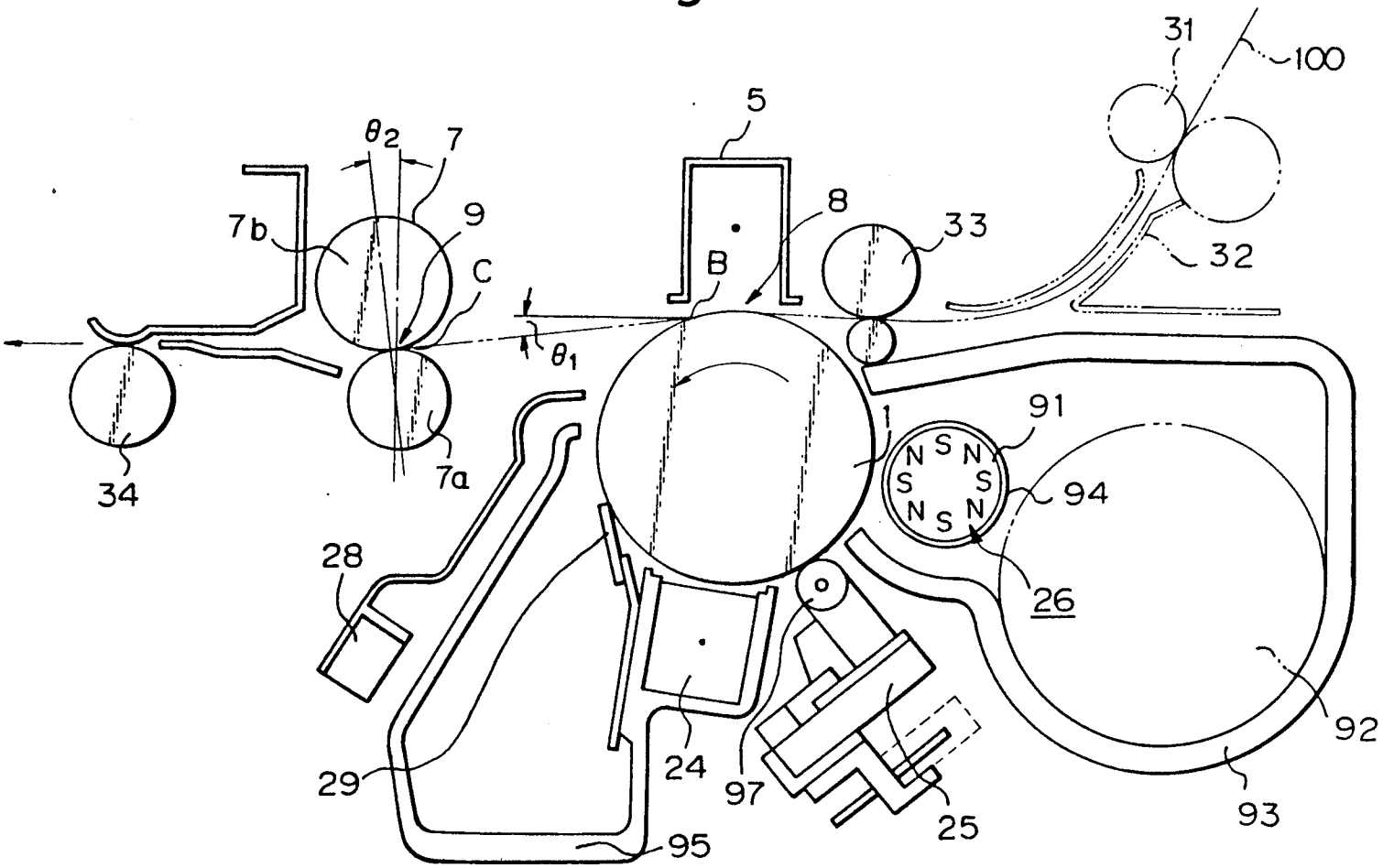
FIG. 4 is a schematic view of an embodiment realizing the concept shown in FIG. 3.

FIGS. 3 and 4 schematically show an aspect of the present invention, in which a nip point C of the fixing station 9 having the fixing unit 7 is located at a level lower than a separation point B of the paper 100 from the photoconductive drum 1. The separation point B corresponds to a point at which the paper 100 is separated from the photoconductive drum 1 due to the stiffness of the paper 100, which depends on the thickness and weight, etc., thereof. The nip point C substantially corresponds to the point of contact between the heat roll 7*a* and the backup roll 7*b*. The heat roll 7*a* and the backup roll 7*b* are rotatably supported by respective shafts which in turn are rotatably supported in the printer body 50. The line connecting the nip point C and the separation point B forms an angle $\theta_1$ with respect to the horizontal line H. When the paper 100 separates from the photoconductive drum 1 at the separation point B, the leading end of the paper 100 droops slightly, due to the force of gravity acting thereon, and enters the fixing station at the nip point C. In theory, the nip point C is located at a position such that the line of travel of the slightly drooped leading end of the paper 100 leads directly to the nip point C. Therefore, the leading end of the paper 100 is smoothly introduced between the heat roll 7*a* and backup roll 7*b* at the nip point C. This results in the prevention of a paper jam which would otherwise occur due to collision of the leading end of the paper 100 with the heat roll 7*a* if the nip point C is located on the same horizontal plane as the separation point B, as shown in FIG. 16.

In FIG. 3, numerals 5 and 8 designate the transfer unit 5 above the photoconductive drum 1 and the transfer station 8 provided with the transfer unit 5. Preferably the fixing station 9 is inclined with respect to the vertical. Namely, the center line connecting the centers of the heat roll 7*a* and the backup roll 7*b* forms an angle $\theta_2$ with respect to the vertical in the direction leaning away from the photoconductive drum 1.

It has been experimentally found that the best results were obtained when $\theta_1=5°\sim10°$, preferably, $\theta_1=7°$, and when $\theta_2=17°$, as will be described hereinafter. FIG. 4 shows an embodiment of an arrangement in which the concept of FIG. 3 is realized. In FIG. 4, the photoconductive drum 1 is surrounded by a corona discharger 24, a latent image forming means (LED array, etc.) 25, a developing unit 26 having a magnetic brush roll 91, which is surrounded by a rotatable sleeves 94, the transfer unit 5 (transfer station 8), an eraser lamp 28, and a cleaner (blade cleaner) 29, as is well known. Note, these components per se are well known. Numerals 93, 95, and 97 designate a toner hopper, a waste toner container, and a gas roll, respectively. The fixing station 9 is placed so that the nip point C thereof is located below the separation point B, with respect to the horizontal plane, by a predetermined value corresponding to the inclination angle $\theta_1$. The developer (toner) 92 is stored in the toner hopper 93.

In FIG. 4, the photoconductive drum 1 rotates in the counterclockwise direction and the paper 100, which is fed by a feed roller 31 through a conveyer passage 32 to a feed roller 33, is then fed by the feed roller 33 into the transfer station 8 in synchronization with the rotation of the photoconductive drum 1. The surface of the photoconductive drum 1 is uniformly charged by the precharger 24, and then a latent image corresponding to the image to be recorded is formed on the photoconductive drum 1 by the latent image forming means (e.g., LED array) 25 known per se. The latent image is developed by the developer 92, and thus a toner image is formed on the photoconductive drum 1. The toner image thus formed is transferred to the undersurface of the paper 100 by the transfer unit 5 in the transfer station 8. After leaving the transfer station 8, the paper 100 is separated from the photoconductive drum 1 at the separation point B, due to the curvature separation effect of utilizing the stiffness of the paper 100, and is fed to the fixing station 9. After leaving the separation point B, the leading end of the paper 100 is caused to droop slightly due to the force of gravity, as mentioned before. This slight droop of the leaving end of the paper 100 is counteracted by the lower location of the fixing station 9, and thus the leading end of the paper 100 is smoothly introduced into the fixing station 9.

The upper 100 is then fixed and is ejected, in the direction indicated by the arrow in FIG. 4, by an eject roller 34 and fed to the stacker 17 (FIGS. 1 and 2), where the papers 100 are stacked in a face-down stack, as mentioned before.

The degree of inclination of the angle $\theta_1$ is fixed in accordance with the distance between the photoconductive drum 1 and the fixing station 9. Note that, since the neat roll 7*a* generates a large amount of heat, the fixing station 9 cannot be located close to the photoconductive drum 1. Namely, a predetermined distance (usually more than 50 mm) must be maintained between the transfer station 8 (photoconductive drum 1) and the fixing station 9. The amount of droop of the leading end of the paper 100 depends on the stiffness or thickness thereof, but is substantially constant for paper having the same stiffness. In experiments carried out by the present inventors, when the distance between the axes of the photoconductive drum 1 and the heat roll 7a was about 51 mm, the amount of droop of the leading end of the paper 100 was about 15 mm when measured from the top point of the photoconductive drum, i.e., the point at which a vertical line passed through the center axis thereof passes through the outer circumference thereof. Therefore, according to above experiments, the nip point C should be located 15 mm lower than the top of the photoconductive drum 1 with respect to the horizontal plane therebetween. In the above mentioned experiment, a 17 lb/Ream paper was used. Note, one Ream consists of 500 sheets, 17 inches×22 inches. The photoconductive drum 1 was an aluminum cylinder 40 mm in diameter as a substrate and having an organic photoconductive layer about 20 μm thick on the substrate, and the surface temperature of the heat roll 70 was around 180° C.

Figure 5:
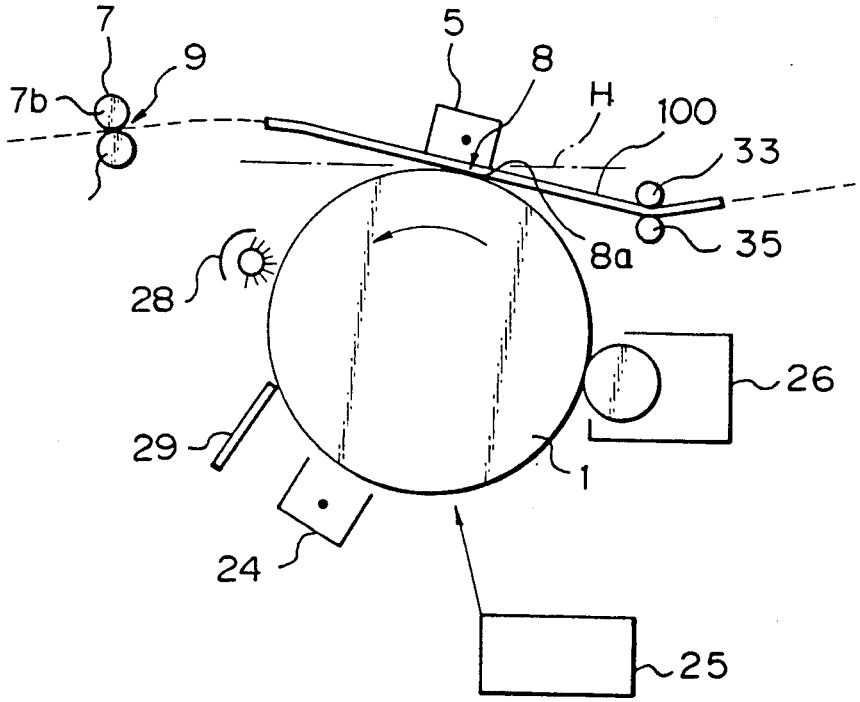
FIG. 5 is a schematic view showing another embodiment of the present invention.
Figure 6:
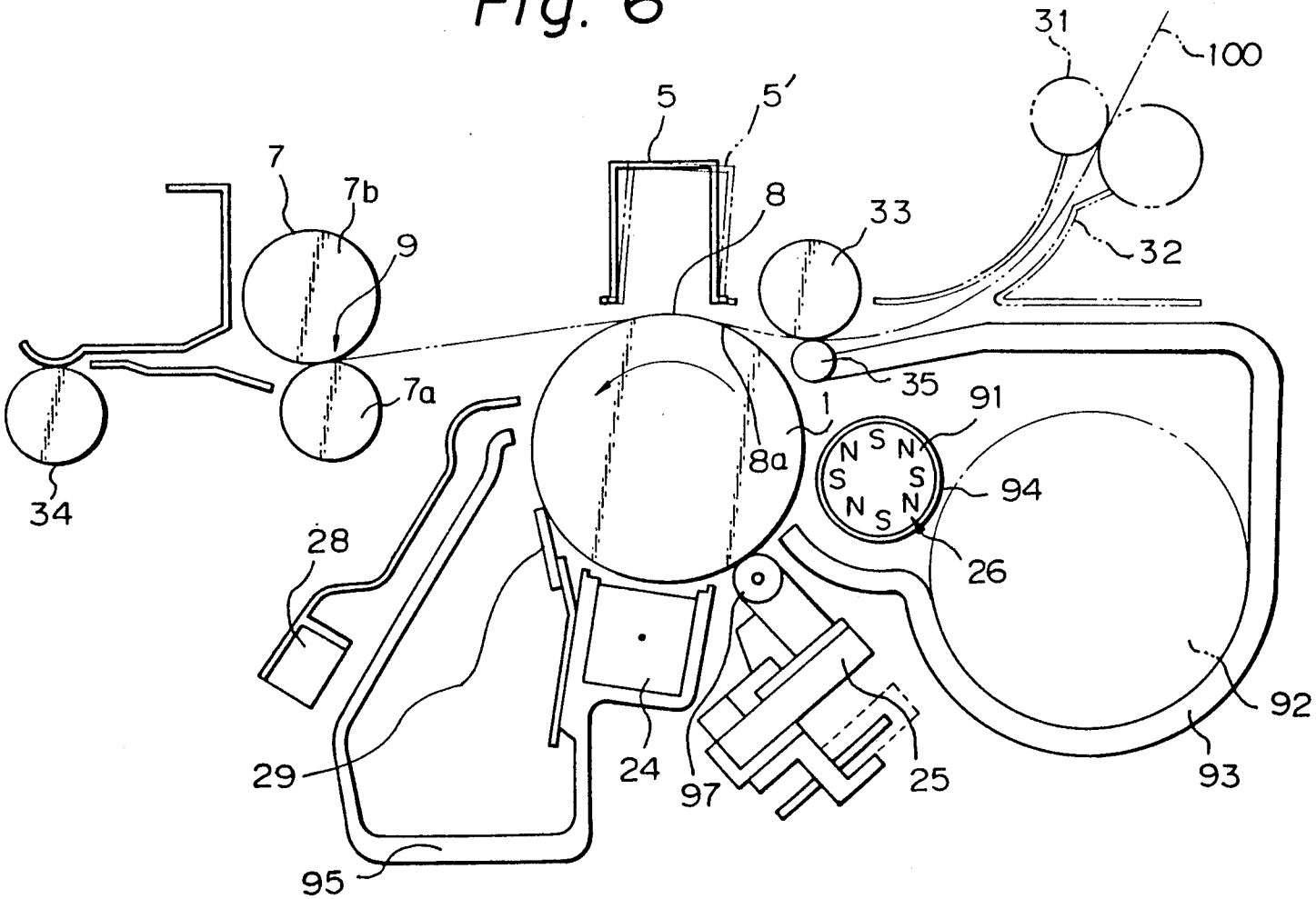
FIG. 6 is a schematic sectional view of the embodiment shown in FIG. 5.

FIG. 5 schematically shows another aspect of the present invention, in which an easier and more certain separation of the paper 100 from the photoconductive drum 1 is realized. In FIG. 5, elements corresponding to those shown in FIGS. 3 and 4 are designated with the same reference numerals. The feature of the arrangement shown in FIGS. 5 and 6 is that the paper 100 is introduced into the transfer station 8 while orientated upwardly. Namely, the paper 100, which is fed by the feed roller 31, is given an upward orientation with respect to the horizontal line H, before being fed into the transfer station 8. This upward orientation of the paper 100 can be realized, for example, by locating the feed roller 33 at a point lower than an entrance 8a of the transfer station 8 through which the paper 100 is fed upwardly by utilizing only the stiffness of the paper as shown in FIG. 5. With this arrangement, since the paper 100 enters the transfer station 8 at an upward angle with respect to the horizontal, the separation of the paper 100 from the photoconductive drum 1 takes place while the paper 100 is traveling at an upward angle. Accordingly, even when the stiffness of the paper is relatively small, the possibility that the leading end of the paper 100, or the vicinity thereof, will be attracted by the photoconductive drum 1 due to static electricity, once it has been separated therefrom, is reduced, and thus the possibility of a paper jam is also reduced.

FIG. 6 shows an embodiment of the arrangement by which the concept of FIG. 5 is realized. In FIG. 6, the paper path defined between the feed roller 33 and a counter roller 35 is located lower than the entrance 8a of the transfer station 8 with respect to the horizontal plane. The entrance 8a can be defined as a point at which the paper 100 comes into contact with the photoconductive drum 1.

The feed roller 33 is driven to feed a paper 100 by a motor through a gear train (not shown), as is well known. The heat roll 7a and the photoconductive drum 1 are also driven by a motor, through respective gear trains (not shown).

It is possible to slightly incline and displace the transfer unit 5 toward the feed-in side of the paper 100, as shown by the phantom line 5' in FIG. 6, so that the transfer unit 5' is located substantially in the middle of the area in which the paper 100 is in contact with the photoconductive drum 1. In the illustrated arrangement, the contact area is slightly extended toward the feed-in side, as the entrance point 8a has been moved in the clockwise direction, because of the lower location of the feed roller 33.

The concept of the lower location of the fixing station 9 shown in FIG. 3 is also incorporated in the arrangement shown in FIG. 6.

Figure 7:
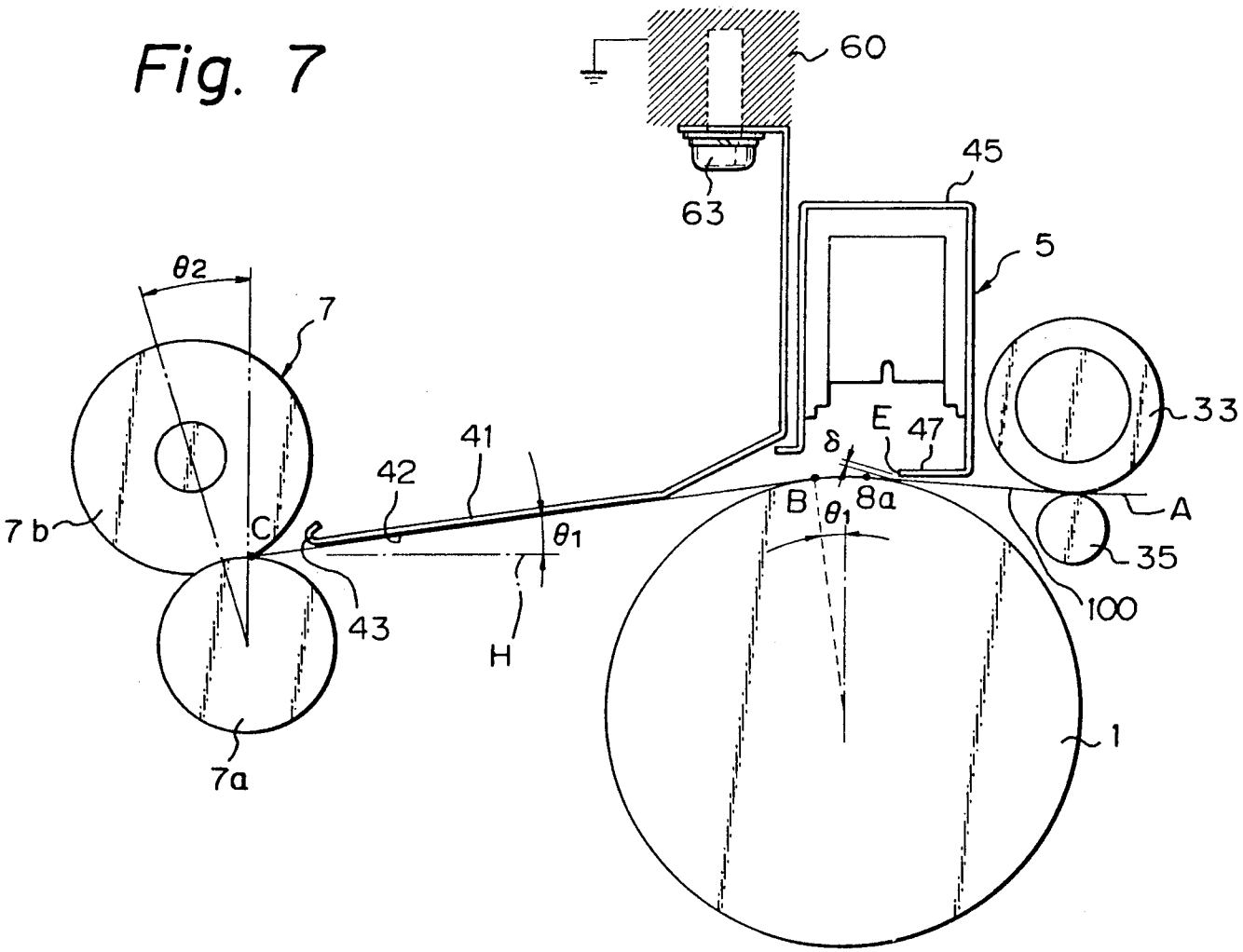
FIG. 7 is a schematic view showing a guide plate according to another aspect of the present invention.

FIG. 7 shows another feature of the present invention, in which a guide plate 41 is provided between the transfer unit 5 and the fixing unit 7 to extend along the paper path A. The guide plate 41 is made of an electrically conductive material and is grounded, and is located above the paper path A so that it comes into contact with the upper surface of the paper 100 passing along the paper path A.

Figure 8:
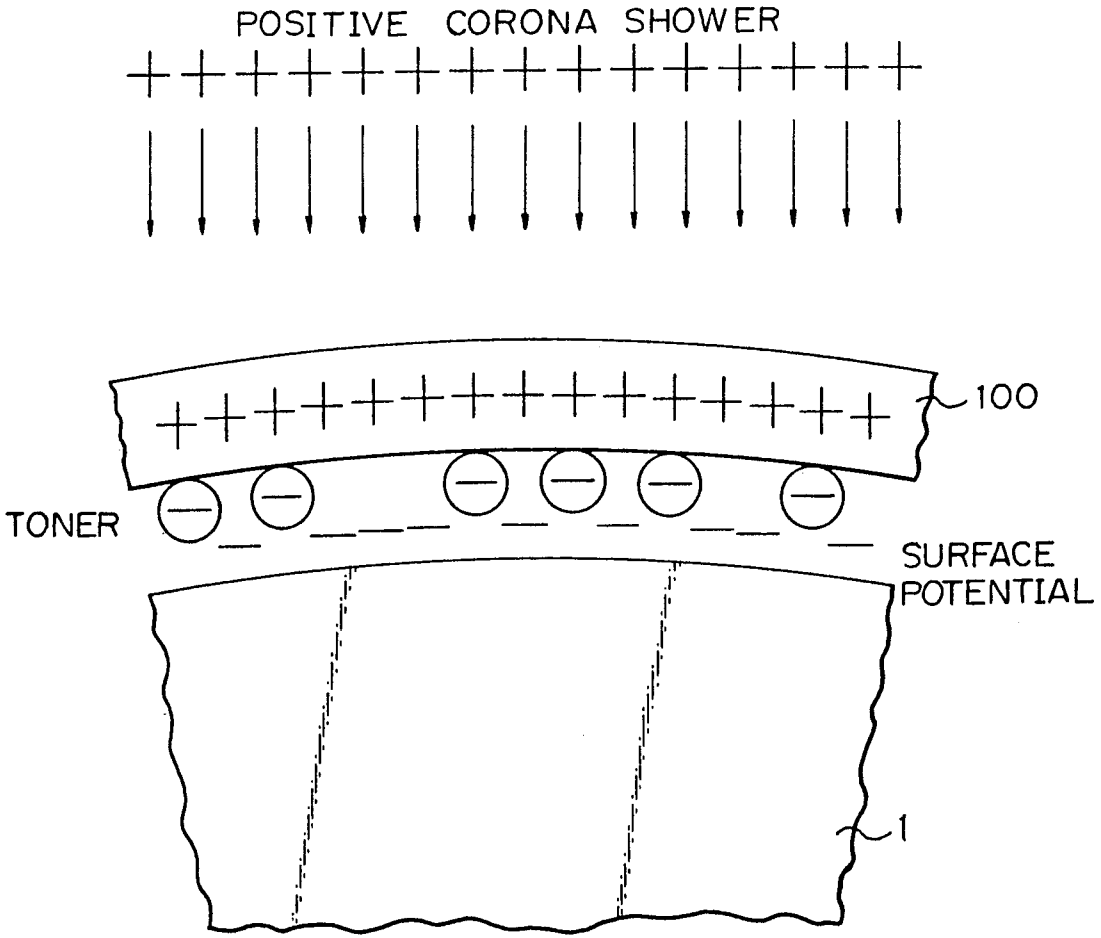
FIG. 8 is an explanatory view showing a principle of transfer of a toner image.

When the paper 100 enters the transfer unit 5 through the entrance point E in FIG. 7, the upper surface of the paper is bathed in a positive (or negative) corona shower, and the paper 100 is charged with a positive (or negative) charge. On the other hand, the visualized toner image (which has, in most printers, the same charge polarity as that on the photoconductive drum, has a negative charge in the illustrated embodiment) on the, photoconductive drum 1 attracts the paper 100 having an opposite polarity, and then the toner image is transferred to the paper 100. Note that in the illustration of FIG. 8, the paper 100 is shown as separated from the toner and the photoconductive drum 1, for clarification. In practice, however paper is always in contact with both the toner and the photoconductive drum 1.

The paper 100, which is usually electrically insulative holds the charges after leaving the transfer station, and separates from the photoconductive drum 1 at the separation point B. The separation can be effected due to the curvature separation effect utilizing the stiffness of the paper 100, which will overcome the Coulomb force between the photoconductive drum and the paper 100, provided that the diameter of the photoconductive drum is small (about 40 mm in the present invention), as mentioned before. Namely, the eraser lamp (discharger), which is usually provided on the circumference of the photoconductive drum to eliminate the charges of the paper and thus ensure an easy separation of the paper from a relatively large photoconductive drum, can be omitted.

Figure 9:
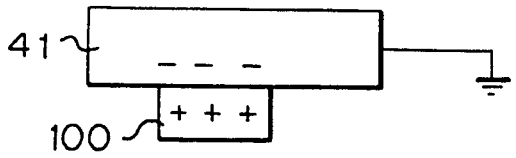
FIG. 9 is a schematic view explaining an image force.

After the paper is separated from the photoconductive drum 1 at the separation point B, the paper moves along the guide plate 41 with the help of an "image force", in which a charge is induced in a grounded conductor when a charged object approaches thereto. Namely, when the paper 100, which has positive charges in the illustrated embodiment, approaches the guide plate 41, which is a grounded conductor, negative charges are induced in a guide plate 41 in the vicinity of the side surface thereof adjacent to the paper 100, as shown in FIG. 9. It should be noted that no charge is induced on the opposite side of the paper 100. Accordingly, a strong and stable Coulomb force, usually called an image force, is produced between the paper 100 and the guide plate 41. Thus because of this Coulomb force, the paper 100 leaving the separation point B can be stably and firmly held by the guide plate 41, so that the paper is not attracted to and stuck again on the photoconductive drum 1 by static electricity. It is understood that the Coulomb force is not strong enough to obstruct the movement of the paper 100.

Figure 10:
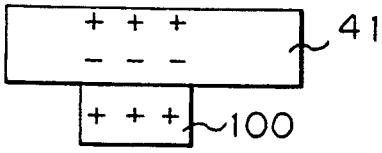
FIG. 10 is a schematic view explaining dielectric polarization.
Figure 12:
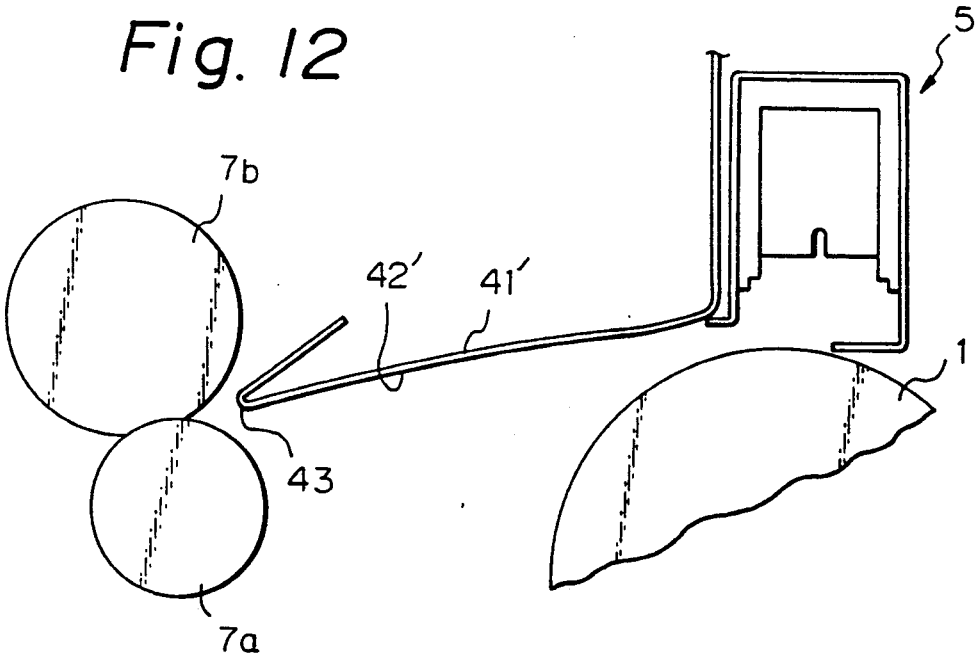
FIG. 12 is a schematic view showing a modified shape of a guide plate shown in FIG. 7.

Note that if the guide plate 41 is not grounded, "dielectric polarization" undesirably occurs, as shown in FIG. 10. Dielectric polarization is a phenomenon in which charges are induced in a dielectric or conductor which is not grounded, when a charged object approaches thereto. Since the dielectric originally has no charge, the same amount of negative and positive charges are induced. In particular, in the case of a conductor, the induced positive and negative charges tend to cancel each other, resulting in a reduction of the Coulomb force, which results in an unstable holding of the paper 100.

The guide plate 41 is extended to the vicinity of the fixing station 9, so that the leading end of the paper 100 can be easily fed into the fixing unit 7.

Figure 11:
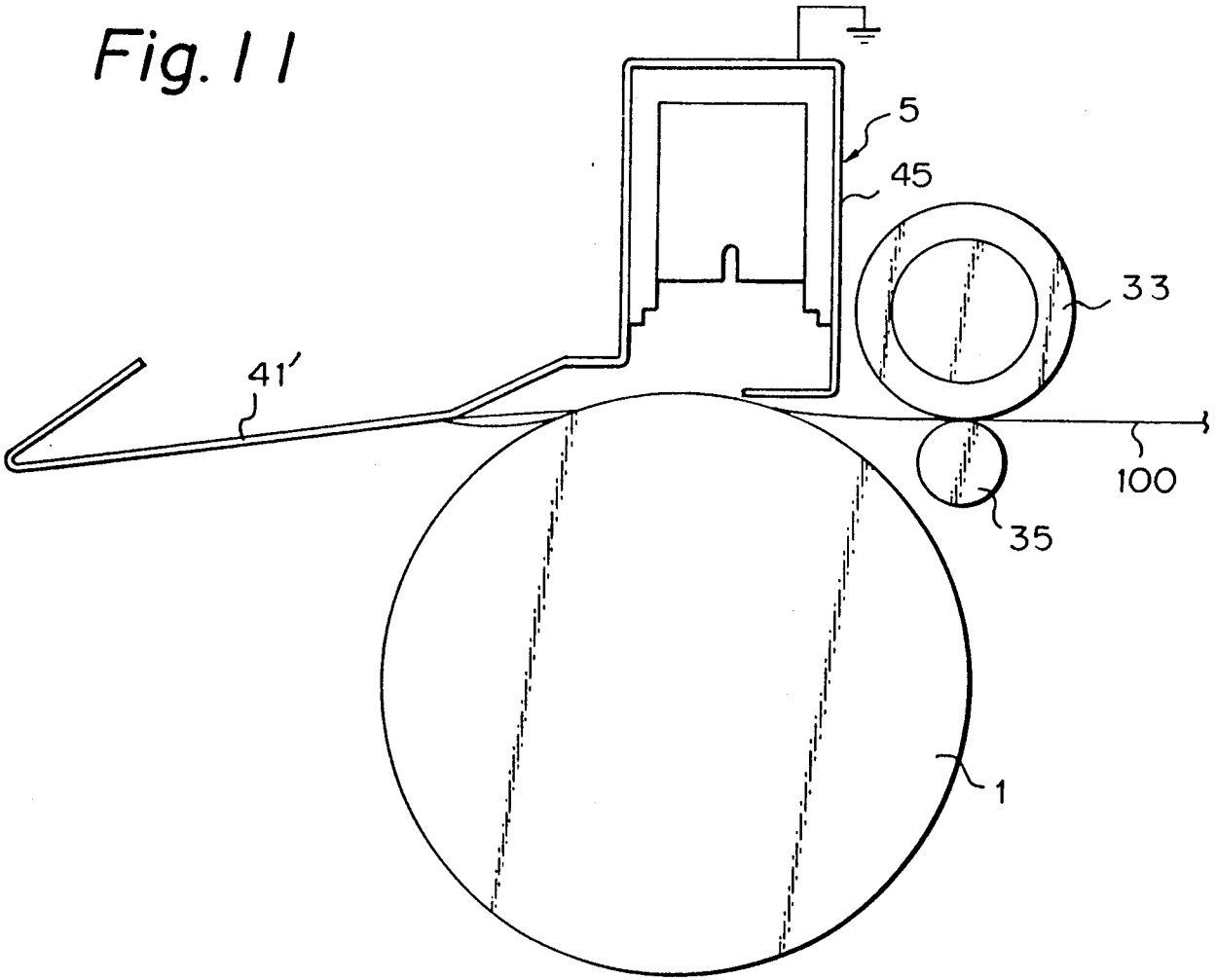
FIG. 11 is a schematic view showing an alternative guide plate according to another aspect of the present invention.

Preferably, the guide plate 41 is connected to the printer body 60 (FIGS. 1, 2, and 7) which is grounded by a bolt 63. Alternatively, it is also possible to form the guide plate 41' as an integral part of the housing 45 of the transfer unit 5, which is preferably made of a metal, for example, stainless steel, and which is grounded as shown in FIG. 11.

The paper 100, which is fed while sliding on the undersurface of the guide plate 41 (41'), separates from the guide plate 41 at the front end 43 thereof, which is bent upward, and is fed into the nip point C between the heat roll 7*a* and the backup roll 7*b* of the fixing unit 7. The bent front end 43 can be located as close as possible to the nip point C. In actual design, the distance between the front end 43 and the nip point C is made as small as possible as shown in FIG. 7. Nevertheless, the possibility remains that the leading end of the paper 100, after separation from the front end 43 of the guide plate 41 may droop due to the force of gravity during the passage of the paper 100 over the distance between the front end 43 and the nip point C, and that the leading end of the paper may collide with the heat roll 7*a* at a point below the nip point C. To eliminate this problem, the housing 45 of the transfer unit 5 is preferably provided with a horizontal guide plate portion 47 which defines the entrance E of the transfer station and which extends along the paper path A, so that the guide plate portion 47 is in contact with the tail end of the paper 100 or the vicinity thereof to prevent the tail end of the paper 100 from floating or moving up when the leading end of the paper 100 droops, provided that the paper 100 has a length extending from the front end 43 to the guide plate portion 47. Namely, the guide plate portion 47 contributes to a prevention of a further droop of the paper 100 at its leading end after leaving the front end 43 of the guide plate 41 by restricting the upward movement of the tail end of the paper 100 which may result from the drooping of the leading end thereof.

In one example, the slight clearance $\delta$ between the guide plate portion 47 and the photoconductive drum 1 is 0.5 mm, in view of the thickness of the paper 100.

Preferably, the guide plate 41 has a flat guide surface 42 which extends along a tangential line common to the photoconductive drum 1 and the heat roll 7*a*, as in the embodiment shown in FIG. 7. In place of the flat guide surface, it is possible to provide a guide plate 42 having a slightly convex guide surface 42'.

Also, in the arrangement illustrated in FIG. 7, the inclination angle $\theta_1$ of the paper path (ideal paper path) with respect to the horizontal, and the inclination angle $\theta_2$ of the center line of the heat roll 7*a* and the backup roll 7*b* with respect to vertical are shown.

Figure 13:
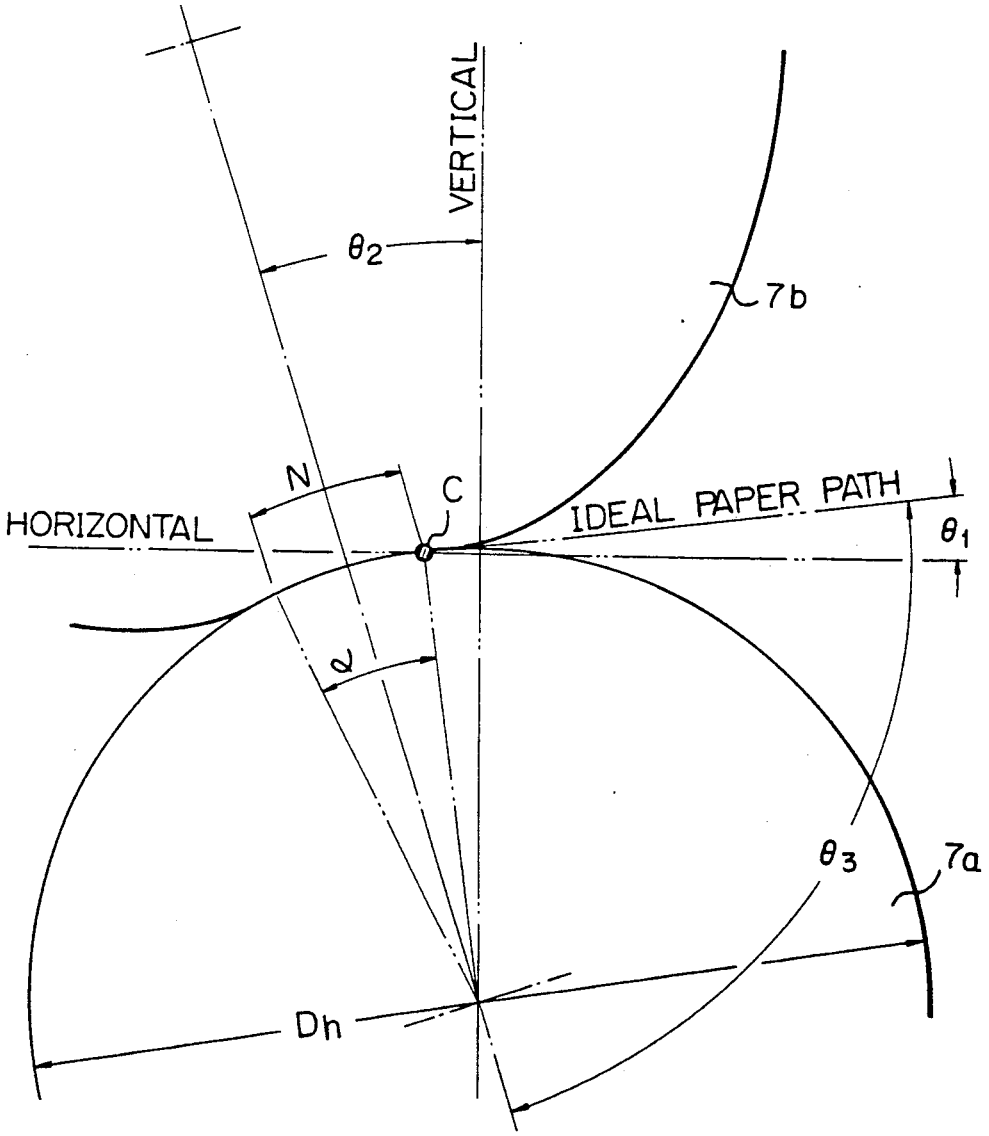
FIG. 13 is an enlarged view showing a relationship between inclination angles of a fixing station and a paper path, according to the present invention.

With reference to FIG. 13, assuming that the angle of the ideal paper path with respect to the center line connecting the centers of the heat roll 7*a* and the backup roll 7*b* is $\theta_3$, the following equation is given:

$$\theta_3-\theta_1+\theta_2=90^\circ$$

Assuming that the nip width between the heat roll 7*a* and the backup roll 7*b* when in press contact with each other is N, then $$N=(D_h/2)\times\alpha$$

wherein, $D_h$ is a diameter of the heat roll 7*a*, and $\alpha$ is a central angle defining the nip width N.

From this obtained, $$90^\circ-\theta_3=\alpha/2$$

and therefore, $$\theta_3=90^\circ-N/D_h$$

When N=2.5 mm, $D_h$=15 mm, and $\theta_3=80^\circ$.

If $\theta_1=7^\circ$ then $\theta_2=17^\circ$.

According to the experiments, when $\theta_1$ is less than 5° ($\theta_1<5^\circ$), the paper sometimes is not kept in close contact with the guide plate 41 while traveling therealong. Also when $\theta_1$ is more than 10° ($\theta_1>10^\circ$), the leading end of the paper 100 is forced into a collision with the guide plate 41 when the paper 100 is attracted thereto by the image force, resulting in a decreased printing quality. This problem becomes more serious when the thickness of the paper is increased. Furthermore, if $\theta_1>10^\circ$, the guide plate 41 may interfere with the cleaner 29 unit (FIG. 6).

Experiments were directed also to $\theta_2=10^\circ$ and 18°. When $\theta_2=10^\circ$, the direction of travel of the paper was largely changed , and a large curl of the paper after fixing by the fixing unit occurred, which had an adverse influence on the stacking of the printed papers. When $\theta_2=18^\circ$, in order to feed the leading end of the paper 100 into the nip point C of the fixing station in a direction substantially identical to the tangential line of the heat roll 17*a*, the entire fixing station 7 had to be moved upward. It is difficult to realize such an upward movement, in view of the inner space of a compact printer, however.

Figure 14:
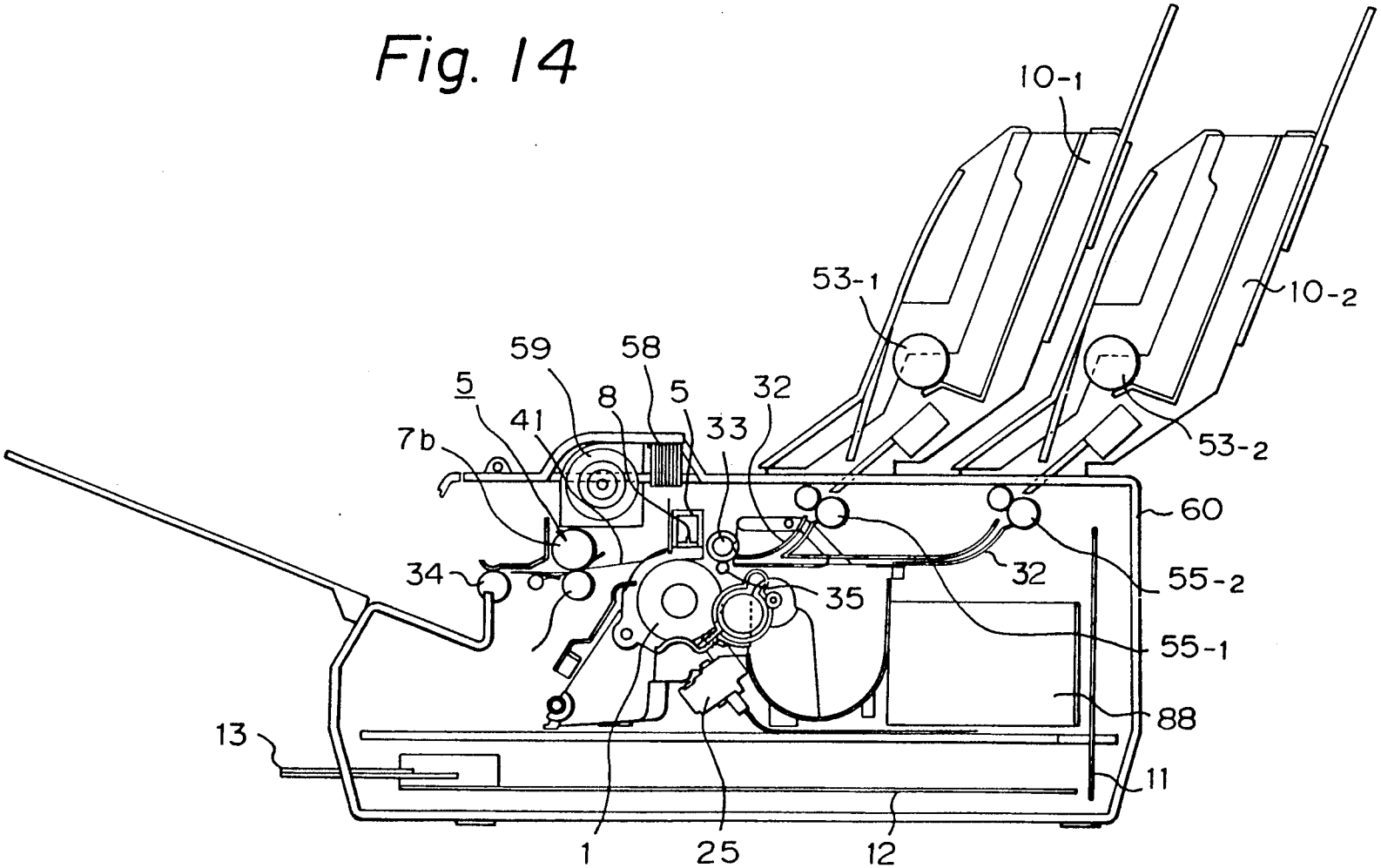
FIG. 14 is a partial schematic view of an internal construction of an actual product of the present invention; and, FIGS. 15 and 16 are views showing different known printing processes.

FIG. 14 shows an internal construction of an actual product of a compact electrophotographic printer in which the above mentioned features of the present invention are incorporated, and which is substantially identical to FIG. 2. In FIG. 14, the paper (not shown in FIG. 14) ejected from the hopper (cut sheet feeder) $\mathbf{10}_{-1}$ or $\mathbf{10}_{-2}$ by the pick roller $\mathbf{53}_{-1}$ or $\mathbf{53}_{-2}$ is advanced by the feed roller $\mathbf{55}_{-1}$ or $\mathbf{55}_{-2}$ along the passage 32. The feed roller 33, which is driven by a motor through a gear train (not shown), is located at a level lower than the entrance 8*a* of the transfer unit 8, as mentioned, before with reference to FIGS. 5 and 6. Accordingly the leading end of the paper is orientated upwardly. When the paper has passed the transfer station, it is separated from the photoconductive drum 1 at the separation point B (FIG. 7 etc.) and is guided by the grounded conductive guide plate 41, which extends with a predetermined downward inclination angle $\theta_1$ (FIG. 7 etc.), due to the image force, and thus the leading end of the paper onto which the toner image is transferred by the transfer unit 5 is fed into the nip point C of the fixing station 9 (FIGS. 3, 4. etc.) without causing a paper jam. The nip point C is located at a level lower by a predetermined amount of displacement than the separation point B (FIG. 3 etc.), as mentioned before. In FIG. 14, 58 designates an ozone filter which eliminates ozone produced by corona charges, and 59 designates a fan which cools the environment inside the printer and allows the air to be exhausted through the ozone filter.

We claim:

1. A recording apparatus comprising:

a cylindrical image carrier having a toner image developed thereon, a transfer station having a transfer unit located above the imaged carrier to transfer the toner imaged to an underside surface of a recording medium having a leading end and moving along a predetermined path extending between the image carrier and the transfer unit, a fixing unit, provided along the path and downstream of a point at which the recording medium ejected from the transfer station is separated from the image carrier, for fixing the toner image onto the underside surface of the recording medium, said fixing unit including at least one pair of a heat roll and a backup roll which come into contact with each other to define a nip which forms an entrance through which the recording medium having the toner image transferred thereon by the transfer unit is introduced into the fixing unit, such that the leading end of the recording medium moves downwardly after separating from the imaged carrier due to gravity force to a point in line with the entrance of the fixing unit, so that the leading end of the recording medium is guided into the entrance of the fixing unit, means, provided only upstream of a point at which the toner image is transferred to the recording medium, for orienting upward the leading end of the recording medium only by the stiffness of the recording medium when the leading end of the recording medium is being fed toward the transfer station, wherein said entrance of said fixing unit is located below a point of separation of the recording medium from the image carrier, and is defined by an intersection point between a center line connecting the center points of the heat roll and the backup roll and the point of contact between the two rolls, and wherein said center line is inclined at an angle between about 10° and 18° with respect to vertical and away from the imaged carrier, and a line connecting said intersection point and said separation is declined at an angle between about 5° and 10° with respect to horizontal.

2. A recording apparatus according to claim 1, wherein said inclination angle is approximately 10°.

3. A recording apparatus according to claim 1, wherein a line connecting the intersection point and the separation point is inclined at approximately 7° with respect to the horizontal.

4. A recording apparatus according to claim 1, further comprising an electrically conductive and grounded guide which extends along the path of the recording medium between the transfer unit and the fixing unit.

5. A recording apparatus according to claim 4, wherein said grounded guide is located above the path of the recording medium so as to come into contact with an upper surface of the recording medium.

6. A recording apparatus according to claim 5, wherein said guide is rigidly connected to the transfer unit.

7. A recording apparatus comprising:

a cylindrical image carrier having a toner image developed thereon, a transfer station having a non-contact type transfer charger unit located above the imaged carrier to transfer the toner image onto an underside surface of a recording medium having a leading end and moving along a predetermined path extending between the imaged carrier and the transfer unit, a fixing unit for fixing the toner imaged on the recording medium discharged from the transfer station, and having a nip portion located at a position such that a line of travel of the recording medium droops towards the nip portion so as to guide the recording medium by gravity; and means, provided only upstream of a point where the toner image is transferred to the recording medium, for orienting upward the leading end of the recording medium only by stiffness of the recording medium when the leading end of the recording medium is being fed toward the transfer station, whereby said recording medium is led through the transfer station and to the fixing unit by gravity induced bending of the recording medium.

8. A recording apparatus according to claim 7, wherein said orienting means comprises guide rollers provided upstream of the transfer station and on opposite sides of the path of the recording medium and located at a level lower than the transfer unit.

9. A recording apparatus according to claim 8, wherein said guide rollers are feed rollers for feeding the recording medium to the image carrier and changing the direction of feed of the recording medium.

10. A recording apparatus according to claim 7, further comprising a fixing unit for fixing the toner imaged onto the recording medium, said fixing unit comprising a heat roll and a backup roll which comes into contact with the heat roll at a contact point located at a level lower than a separation point at which the recording medium is separated from the imaged carrier, the vertical position of said contact point being selected to be located on the extension of travel of the leading end of the recording medium and being dependent on the weight and stiffness of the recording medium.

11. A recording apparatus according to claim 10, further comprising a grounded guide plate for guiding the recording medium ejected from the transfer unit into the fixing unit.

12. A recording apparatus comprising:

a cylindrical image carrier having a toner image developed thereon, a transfer station having a non-contact type transfer unit located above the imaged carrier to transfer the toner image to an underside surface of a recording medium having a leading end and moving along a predetermined path extending between the imaged carrier and the transfer unit, the non-contact type transfer unit comprises a housing made of metal which is connected to the ground, a fixing unit, provided along the path and downstream of a point at which the recording medium ejected from the transfer station is separated form the image carrier, for fixing the toner image onto the underside surface of the recording medium, said fixing unit including at least one pair of a heat roll and a backup roll which comes into contact with each other to define a nip which forms an entrance through with the recording medium having the toner image transferred thereon by the transfer unit is introduced in to the fixing unit the nip of the fixing unit being located below a point of the transfer station, means, provided only upstream of a point at which the toner image is transferred to the recording medium, for orienting upward the leading end of the recording medium only by the stiffness of the recording medium when the leading end of the recording medium is being fed toward the transfer station, and an electrical conductor plate which is located along a path extending from the transfer station to the nip, said plate being connected tot he housing of the non-contact type transfer unit and being electrically grounded through the housing thereof.

13. A recording apparatus according to claim 12, wherein said guiding means is a grounded guide located above the path of the recording medium so as to come into contact with an upper surface of the recording medium,

14. A recording apparatus according to claim 13, wherein said guide is rigidly connected to the transfer unit.

15. A recording apparatus according to claim 13, wherein said fixing unit comprises at least one pair of a heat roll and a backup roll, which come into contact with each other to define a nip which forms said entrance of said fixing unit.

16. A recording apparatus according to claim 15, wherein said entrance of the fixing unit is defined by an intersection point between a center line connecting the center points of the heat roll and the backup roll and the point of contact between the two rolls and wherein said center line in inclined at a predetermined angle of inclination with respect to the vertical.

17. A recording apparatus according to claim 16, wherein said inclination angle is approximately 10°.

* * * * *